US006763215B1

(12) United States Patent
Jones

(10) Patent No.: US 6,763,215 B1
(45) Date of Patent: Jul. 13, 2004

(54) TONER CARTRIDGE OR CASSETTE OPEN/ CLOSURE APPARATUS

(75) Inventor: Bruce S. Jones, Franklin, TN (US)

(73) Assignee: Nu-Kote International, Inc., Dallas, TX (US)

( * ) Notice: Subject to any disclaimer, the term of this patent is extended or adjusted under 35 U.S.C. 154(b) by 0 days.

(21) Appl. No.: 10/184,323

(22) Filed: Jun. 27, 2002

Related U.S. Application Data

(60) Provisional application No. 60/301,570, filed on Jun. 27, 2001.

(51) Int. Cl.[7] ..... G03G 15/08

(52) U.S. Cl. ..... 399/260; 222/DIG. 1; 399/106

(58) Field of Search ..... 399/106, 258, 399/260, 262; 222/DIG. 1

(56) References Cited

U.S. PATENT DOCUMENTS 4,625,895 A * 12/1986 Tsukano ..... 222/DIG. 1
5,111,976 A * 5/1992 Ban ..... 222/DIG. 1
5,398,849 A * 3/1995 Smith et al. ..... 399/262 X
5,449,095 A * 9/1995 Kobayashi ..... 222/DIG. 1

FOREIGN PATENT DOCUMENTS

JP 4-369670 * 12/1992
JP 11-212344 * 8/1999
JP 11-272054 * 10/1999

* cited by examiner

*Primary Examiner*—Fred L. Braun
(74) *Attorney, Agent, or Firm*—Fay, Sharpe, Fagan, Minnich & McKee, LLP

(57) ABSTRACT

A toner cartridge has a base and a slide slidably received in a slot of the base with at least one opening therein. A rotatable knob is inserted into the slide opening, wherein knob rotation results in a portion of the knob contacting a slide opening, thus moving the slide with respect to the base to one of a fully opened and fully closed position. The knob can include an eccentric cam which engages the slide opening to cause slide movement. The knob can have an axle which engages an opening in the base. The knob also can have a plurality of teeth on an outer edge thereof. The slide opening can have teeth which engage the teeth of the knob to move the slide with respect to the base.

21 Claims, 7 Drawing Sheets

TONER CARTRIDGE OR CASSETTE OPEN/ CLOSURE APPARATUS

CROSS-REFERENCE TO RELATED APPLICATION

This application claims the benefit of U.S. Provisional Serial No. 60/301,570, filed on Jun. 27, 2001.

BACKGROUND OF THE INVENTION

This invention relates to a toner cartridge or cassette for supplying toner to the developing device of an image forming apparatus such as an electrostatic copying apparatus or the like.

Generally, a toner cartridge has a hopper area for storing a predetermined supply of toner and is provided with a toner flow or outlet region disposed in the bottom area thereof. Removable closure or seal means is provided to open the toner flow or outlet region when and as desired to facilitate toner flow into an associated copy machine. The closures or seals typically employed include thin flexible strips, seal tape, shiftable shutters and the like.

Replacement toner cartridges are desirably first installed in a closed condition in an associated image forming apparatus. The closure or seal member may then be opened or removed to allow toner in the hopper area to flow outwardly from the cartridge into the image-forming apparatus for use. In some cases, the cartridge remains in place on the apparatus while in other cases the cartridge is immediately removed. This really is a function of the apparatus design and operational parameters.

In either situation, it is important to be able to re-close the toner flow or outlet region during cartridge removal to prevent unacceptable and undesired toner spills. That is, a small amount of residual toner may remain in the cartridge even though the cartridge may be considered empty from an operational point of view. Thus, it is highly desirable to have effective and reliable means to re-close the cartridge to avoid toner spillage during cartridge removal. Toner is comprised of very small particles which, if undesirably released, can create a dirty work environment and cause operational and quality difficulties in the image forming apparatus itself.

Some existing toner cartridges have toner flow or outlet openings which can be closed by a plate-like cover prior to removal of the cartridge. However, the covers are sometimes rather loose fitting so that some residual toner can still escape into the air and onto the imaging apparatus. Some other existing cartridges use selectively shiftable shutter mechanisms to open and close toner flow. There, however, it is oftentimes difficult for the user to determine whether the shutter is completely or partially open or closed before lifting or removing the toner cartridge from the image-forming apparatus. This, too, presents the potential for unknowingly spilling residual toner. Moreover, if the plate-like covers or shutters are dimensioned to be close fitting with the associated cartridge to prevent spillage, they may be very difficult to open and close. This, in turn, creates an entirely different set of problems.

Accordingly, it has been considered desirable to develop an improved toner cassette which would overcome the foregoing difficulties and others while providing better and more advantageous overall results.

BRIEF SUMMARY OF THE INVENTION

The present invention relates to a toner cartridge or cassette having a louvered slide mechanism which may be selectively opened and closed for allowing or blocking toner flow therefrom. The present invention provides a mechanical arrangement for allowing the user to know when the cartridge is open or closed, and has the added advantage of providing a mechanical advantage over existing slide mechanisms to effect ease of opening and closing.

Current louvered slide mechanisms do not indicate if the cartridge is open (allowing toner to drop from the bottom) or closed. One aspect of the invention is to indicate to the end user that the cartridge is fully open or closed. Also, existing toner cartridges have slides and slide mechanisms which are oftentimes difficult to move by hand pulling or pushing. The present invention provides an eccentric knob or cam which provides a mechanical advantage to the opening and closing process.

More particularly, the present invention relates to a toner cartridge having a hopper with a bottom wall with at least one outlet opening in the bottom wall. A base receives the hopper and also has at least one outlet opening therein and a slot extending from a first end to a second end. A slide is slidably received in the slot of the base and also has at least one outlet opening therein. A loading tray can be provided which has a slot in which the base is received within the slot.

A rotatable knob or movable member is inserted into a second opening in the slide, wherein rotation of the knob results in a portion of the knob contacting the second opening of the slide, thus moving the slide with respect to the base and the hopper in a linear fashion to one of a fully opened and fully closed position. In a fully opened position, each outlet opening of the hopper, base and slide is in registry, allowing toner to flow out of the hopper to an image forming apparatus. In a fully closed position, each outlet opening of the slide is not in registry with the hopper and base openings, thus preventing toner flow out of the hopper.

The knob has a first surface having a handle and a second surface having an eccentric cam and an opening. A pin is inserted through a hole of the base and engages the opening of the knob. The eccentric cam engages the side wall of an opening of the slide to cause the slide to move with respect to the base. This slide opening can be rectangular or square. Labels can be provided on the slide to indicate the fully opened and fully closed positions.

The knob can have an eccentric cam and an axle, instead of a separate pin, where the axle engages the hole of the base. The knob can further have a plurality of teeth around an outside edge thereof. The slide can include an elongated opening with a plurality of teeth on an inner wall thereof. The teeth of the knob would matingly engage the teeth of the slide and rotation of the knob results in engagement of the teeth which in turn moves the slide with respect to the base. This rack and pinion arrangement allows a greater range of movement of the slide.

One advantage of the present invention is found in the provision of an indicator to the user that the cartridge is fully opened or closed.

Another advantage of the invention resides in the provision of a device for adding a mechanical advantage to the louvered slide mechanism for making it easier to open and close a cartridge.

Yet another advantage of the invention resides in the provision of a knob with a rack and pinion arrangement to provide a large range of movement.

Still other advantages and benefits of the invention will become apparent to those skilled in the art upon a reading and understanding of the following detailed description.

BRIEF DESCRIPTION OF THE DRAWINGS

The invention may take form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
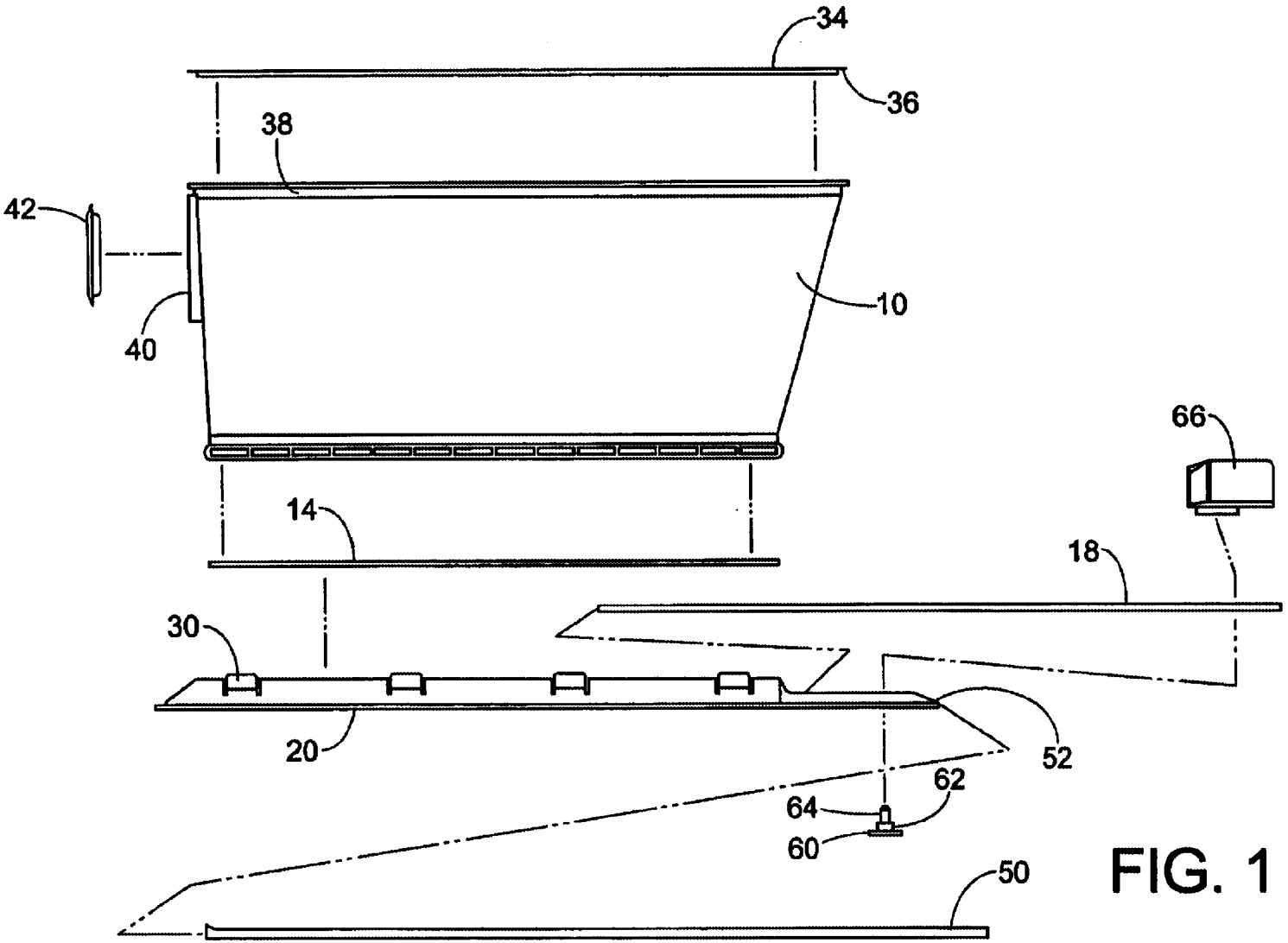
FIG. 1 shows an exploded side elevational view of the toner cartridge with a mechanical advantage mechanism found in a preferred embodiment in accordance with the present invention.

Referring now to the drawings wherein the showings are for the purposes of illustrating the preferred embodiments of the invention only and not for purposes of limiting same, FIG. 1 shows an exploded side elevational view of the toner cassette formed in accordance with the first preferred embodiment of the present invention.

Figure 6:
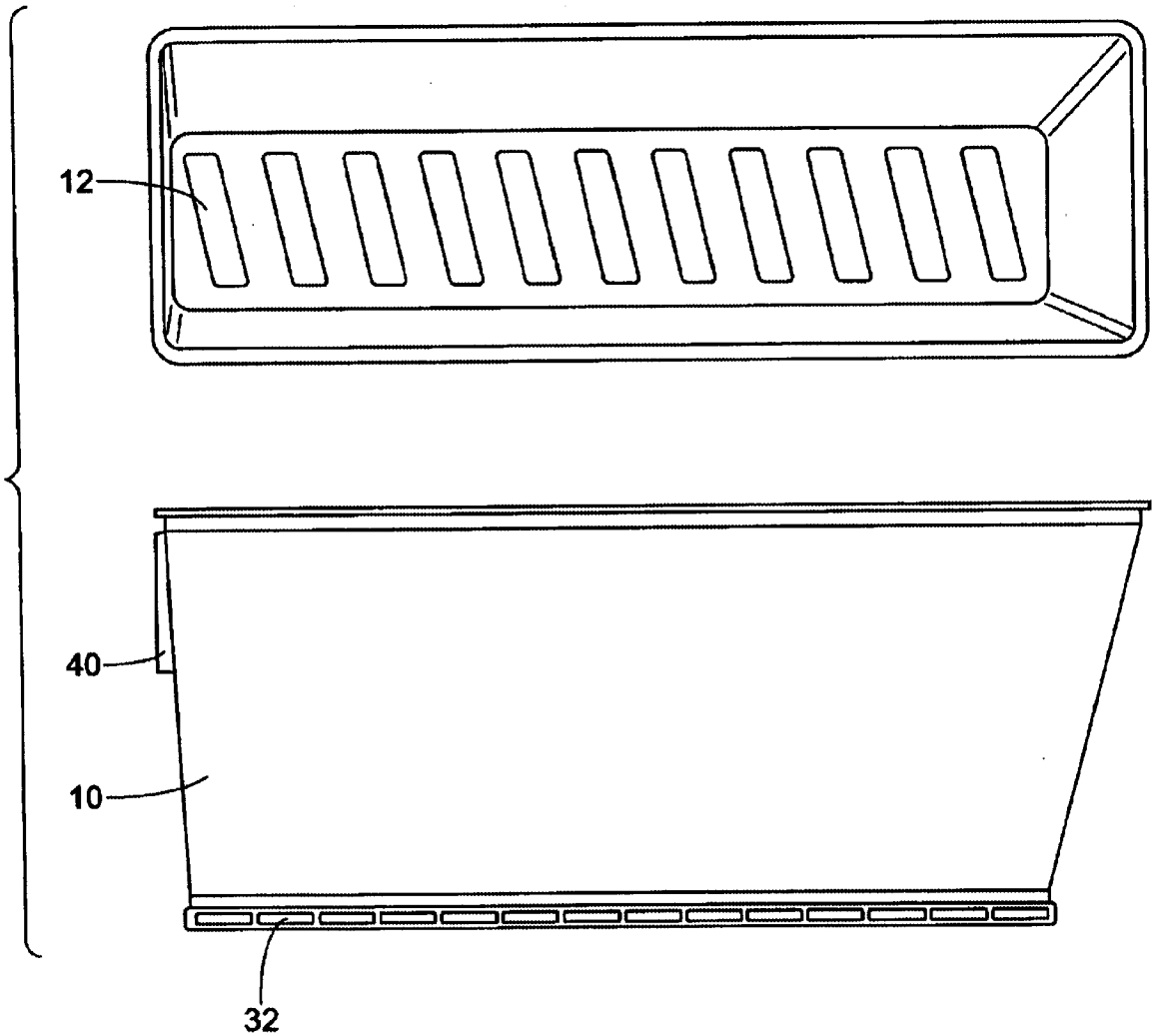
FIG. 6 shows a bottom elevational view and a side elevational view of a hopper of the toner cartridge of FIG. 1.

Referring to FIGS. 1 and 6, the cassette has a hopper 10 with a series of outlet openings or windows 12 spaced longitudinally along the bottom wall thereof. This hopper may be formed by convenient means such as blow molding, vacuum forming or the like. Openings 12 can be equally spaced apart and are offset at an angle along a longitudinal axis of the hopper as well as along a transverse axis of the hopper. The openings can also be normal to the longitudinal axis and transverse axis.

Figure 2:
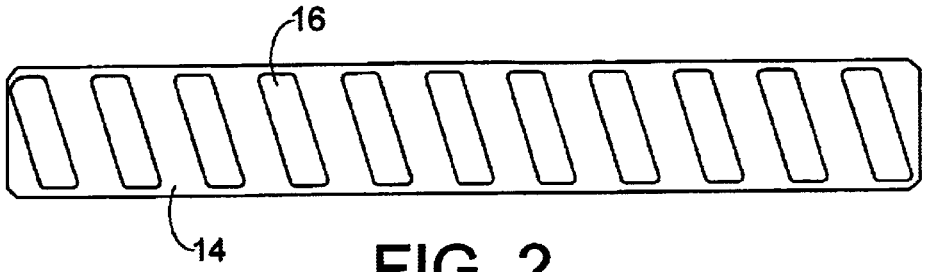
FIG. 2 shows a bottom elevational view of a gasket of the toner cartridge of FIG. 1.

Referring to FIGS. 1 and 2, a flexible gasket 14 having a series of through or outlet openings 16 to match those in the bottom of the hopper is affixed to the hopper 10 by removing a silicon paper or similar covering and positioning the gasket to align the openings 12, 16 in registry with an adhesive side of the gasket toward the hopper. The gasket is firmly pressed against the hopper bottom. The gasket 14 can be made from polyurethane foam or other suitable material as may be desired.

Figure 3:
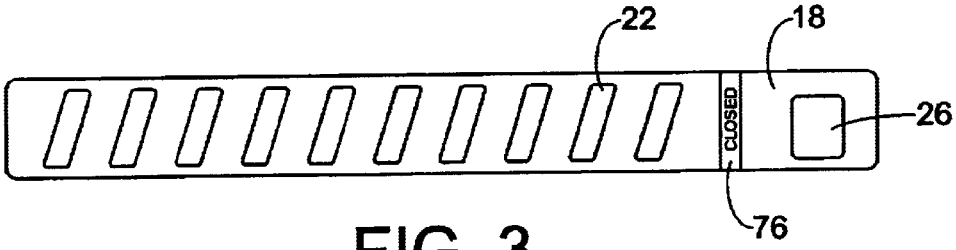
FIG. 3 shows a top elevational view of a slide of the toner cartridge of FIG. 1.
Figure 4:
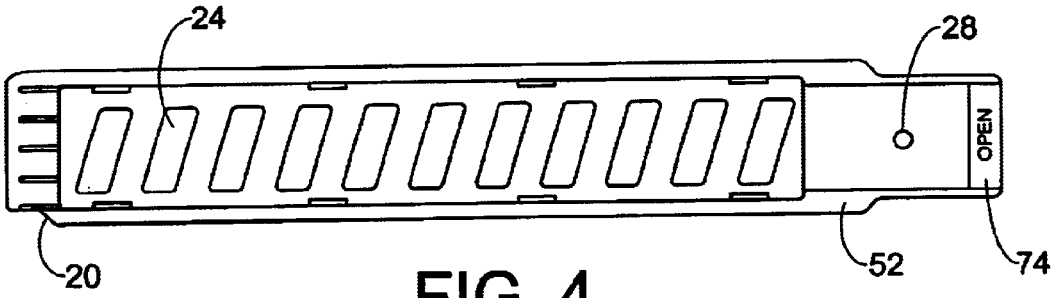
FIG. 4 shows a top elevational view of the base of the toner cartridge of FIG. 1.

Referring to FIGS. 1, 3 and 4, a molded plastic louvered slide 18 is received in a slot in a base 20. The slide 18 has window or outlet openings 22 spaced equally apart or in a manner so that when the slide is fully inserted or slid into the base, the window openings are aligned with openings 24 of the base to allow toner flow in a manner to be described. The slide has a rectangular-shaped cam hole 26 which is positioned over a round hole 28 in the base. The cam hole 26 could also be of a different configuration, such as a round hole.

The toner storage hopper 10 is installed onto base 20 by aligning the openings 12 with openings 24 in the base and firmly seating the hopper onto the base. Eight clips 30 on the base align with and engage top surfaces of corresponding ribs 32 on the hopper to firmly hold the hopper onto the base.

Referring to FIG. 1, a lid 34 is welded or fixed into position in the top of the hopper. Ribs 36 on the lid are aligned with channels 38 on the top of the hopper. A fill hole 40 is located on a side of the hopper for filling the hopper with toner. When the hopper is installed on the base, the fill hole 40 is on a side opposite to a side adjacent the opening 28 in the base. A cap plug 42 is shipped separately with the hopper. The plug is installed into hole 40 after the hopper is filled with toner. Other toner hopper shapes and assembly techniques may also be used to accommodate a variety of different applications.

Figure 5:
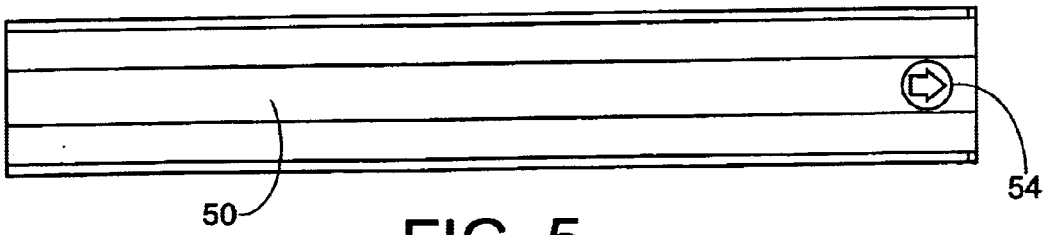
FIG. 5 shows a top elevational view of a load tray for the toner cartridge of FIG. 1.

Referring to FIGS. 1 and 5, a load tray 50 is slid over the bottom of the base. Flanged edges 52 of the base serves as alignment slots for the load tray. An arrow 54 on the load tray is to be located on the same side as the hole 28 in the base.

With reference again to FIG. 1, an axle pin 60 is inserted through the bottom of the base 20 and through hole 28 and seated in a counterbore 62 of the pin with a small diameter 64 extending through hole 28 and hole 26.

Figure 7A:
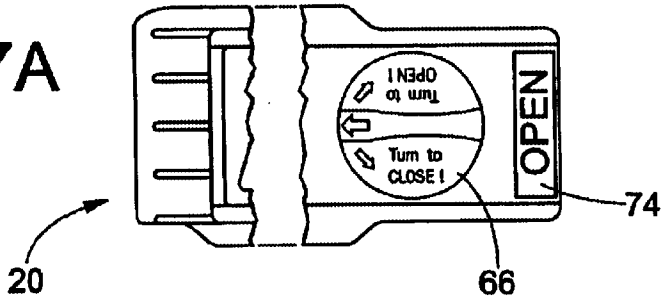
FIG. 7A shows a top elevational view of the eccentric knob installed on the slide of the toner cartridge of FIG. 1.
Figure 7:
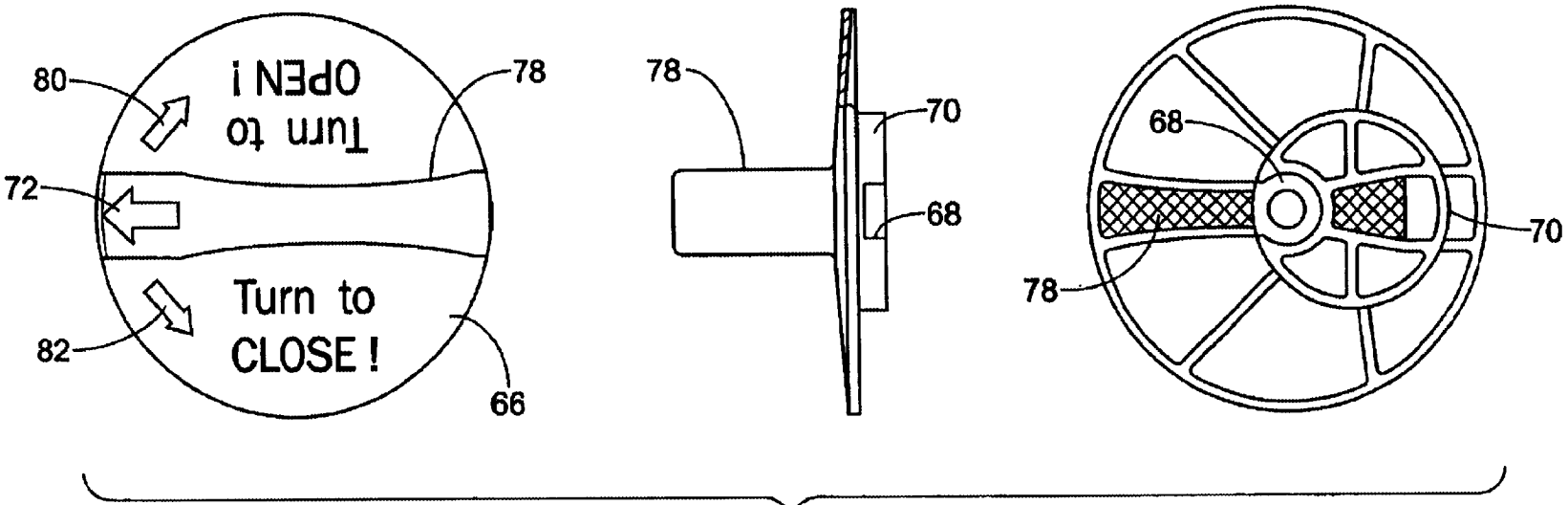
FIG. 7 shows a top, side and bottom elevational view of an eccentric cam knob of the toner cartridge of FIG. 1.

Referring to FIGS. 1, 7 and 7A, an eccentric knob 66 is aligned with pin 60 and mounted onto the pin by aligning a hole 68 in the knob with the top of the pin and pressing the knob onto the pin until the knob bottoms out on a shoulder of the pin.

An eccentric cam 70 is fully positioned within the cam hole 26 on the slide 18. The eccentric cam is rotatable in hole 26 so that the cam surface will engage the side wall of the hole. This cooperating action will cause the slide to shift or slide relative to the base so that window openings 24, 22 and 12 of the base, slide and hopper, respectively, are moved toward registry; therefore, allowing toner to freely flow into the image-forming apparatus as the knob assembly is rotated 90° or 180° to the open position. The eccentric cam adds a mechanical advantage thus rendering it far easier for the user to open and close the slide.

Referring to FIGS. 7 and 7A, an arrow 72 on the knob points toward the hopper 10 and away from a "OPEN" label 74 on the base when installed. The "OPEN" label along with a "CLOSED" label 76 on the slide indicate to the user whether the slide is in the open or closed position. This, in turn, enables the user to avoid undesired toner spilling when removing the toner cartridge from the image forming apparatus.

The knob is manually rotated via a handle 78. When the knob is rotated clockwise to the open position, as indicated by arrow 80 on the knob, the slide 18 moves inwardly, thus aligning the openings 12, 22 and 24 and exposing the "OPEN" label 74 on the base and covering the "CLOSED" label 76 on the slide. When the knob is rotated counterclockwise to the closed position, as indicated by arrow 82 on the knob, the slide moves outwardly, moving the windows 12, 22 and 24 out of registry, thus blocking flow of toner out of the hopper. The "OPEN" label is covered by the slide, and the "CLOSED" label on the slide is exposed.

While the invention has been described with slide 18 fully inserted into base 20 when the hopper is opened, it would also be possible to construct the cartridge so that the slide would be moved to the fully inserted position in the base to close the hopper. The cam assembly could also be advantageously employed in this modified construction.

Figure 8:
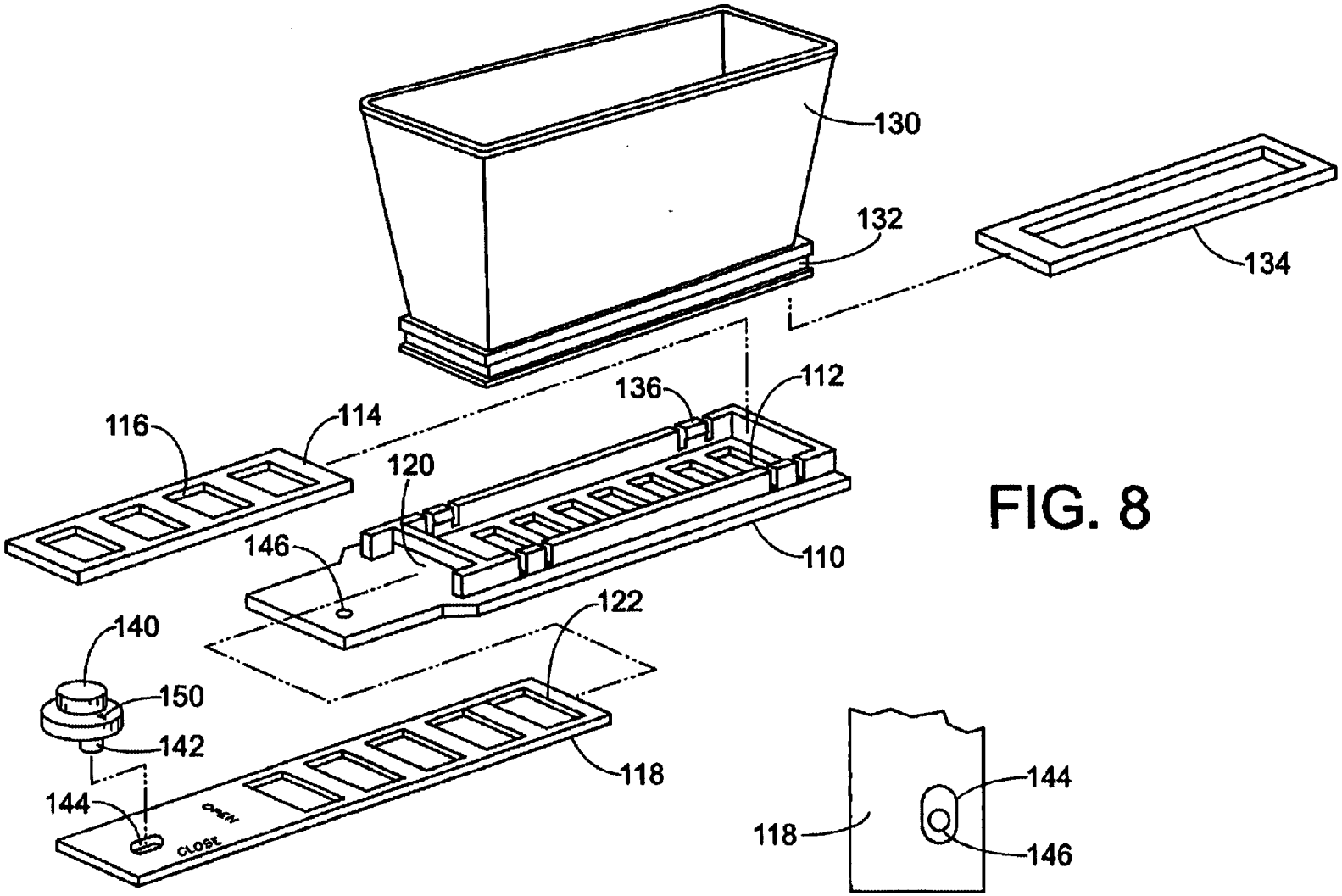
FIG. 8 is an exploded perspective view of the toner cartridge with a mechanical advantage mechanism formed in accordance with a second preferred embodiment of the present invention.
Figure 9:
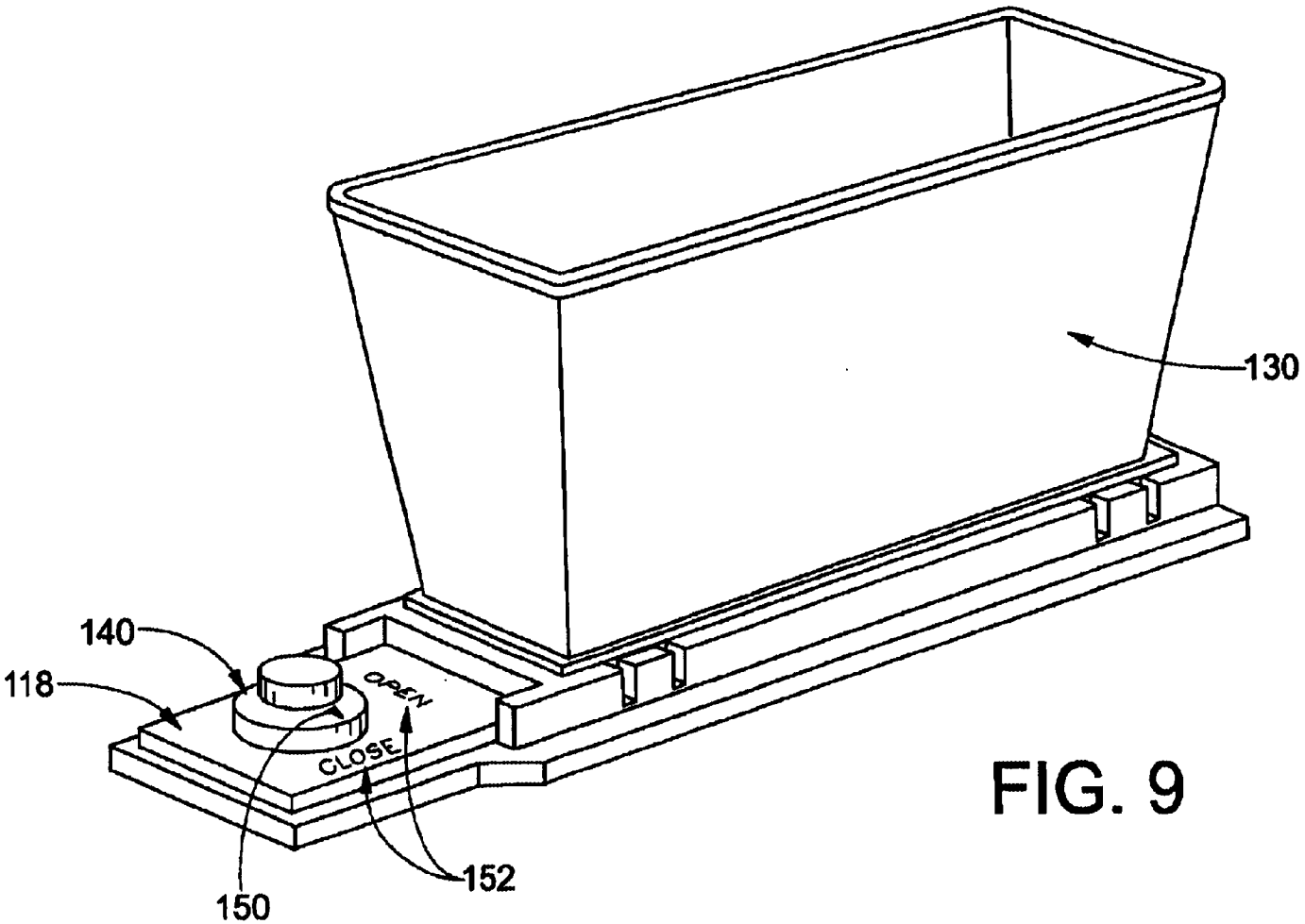
FIG. 9 shows a perspective view of the assembled toner cartridge of FIG. 8.

Referring now to FIGS. 8 and 9, a cassette in accordance with a second preferred embodiment is shown. The cassette has a base 110 with a series of openings or windows 112 spaced longitudinally along the bottom wall thereof. A flexible gasket 114 having a series of through openings 116 to match those in base 110 is adhesively secured to the inside or top surface of the base so that openings 112, 116 are disposed in registry. The gasket 114 can be made from polyurethane foam or other suitable material as may be desired.

A molded plastic louvered slide 118 is received in a slot 120 in the base. The slide 118 has window openings 122 spaced in a manner so that when the slide is fully inserted or slid into the base, the window openings are aligned with the closed sections of the base intermediate openings 112 to close and seal the cartridge for preventing toner flow.

A toner storage hopper 130 is provided for installation onto base 110. This hopper may be formed by convenient means such as blow molding, vacuum forming or the like, and includes a gasket receiving groove 132 formed peripherally around the bottom edge thereof. Groove 132 closely receives a hopper seal gasket 134 of a suitable type and material. This hopper assembly is snapped onto base 110 and retained firmly in place by a series of snap hook fingers 136 integrally molded into the base. Other toner hopper shapes and assembly techniques may also be used to accommodate a variety of different applications.

With continuing reference to both FIGS. 8 and 9, an eccentric cam assembly 140 has an axle 142 inserted through a hole 144 in the slide, and locks into a hole 146 in base 110. Axle 142 is rotatably received in hole 146 and is prevented from removal by a lock tab, a headed pin or by other convenient means. An eccentric cam disposed at the base of the knob assembly is rotatable in hole 144 of slide 118 so that the cam surface will engage the side wall of the hole. This cooperating action will cause the slide to shift relative to base 110 so that window openings 112, 122 are moved toward registry, thereby allowing toner to freely flow into the image forming apparatus as the knob assembly is rotated either 90° or 180°. The eccentric cam adds a mechanical advantage thus rendering it far easier for the user to open and close the slide.

Referring to FIG. 9, the cam has a "tick" mark 150 so that the open and closed positions can be indicated by markings or indicia 152 on the top surface of the slide. The open and closed positions can be 90° or 180° apart. Thus, the "tick" mark 150 and the markings 152 indicate to the user whether the slide is in the open or closed position. This, in turn, enables the user to avoid undesired toner spilling when removing the toner cartridge from the image forming apparatus.

While the invention has been described with slide 118 fully inserted into base 110 when the hopper is closed, it would also be possible to construct the cartridge so that the slide would be moved to the fully inserted position in the base to open the hopper. The cam assembly could also be advantageously employed in this modified construction.

Figure 10:
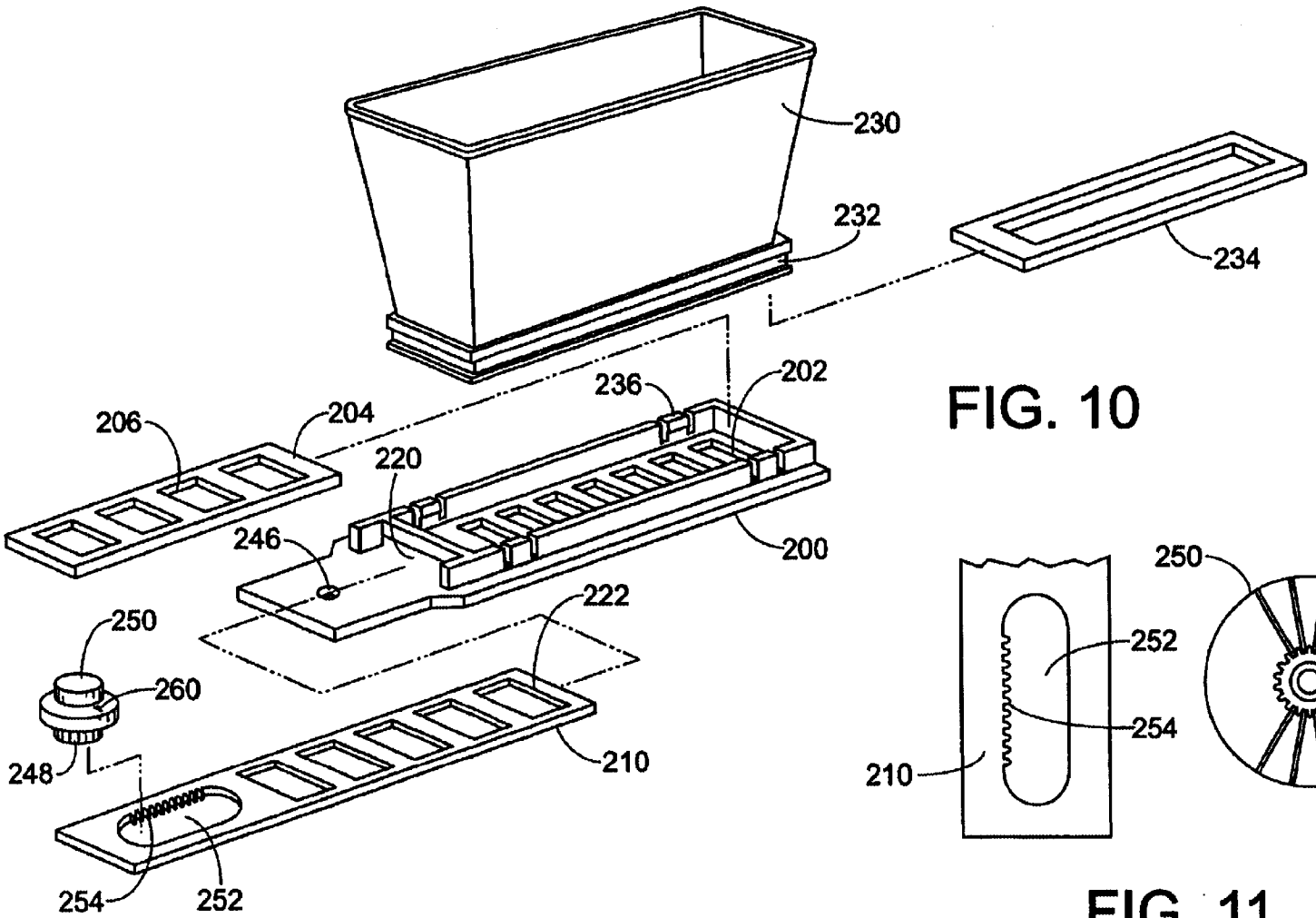
FIG. 10 is an exploded perspective view of the toner cartridge with a mechanical advantage mechanism formed in accordance with a third preferred embodiment of the present invention; and, FIG. 11 is an enlarged top view of a slide and knob assembly of the toner cartridge of FIG. 10.
Figure 11:
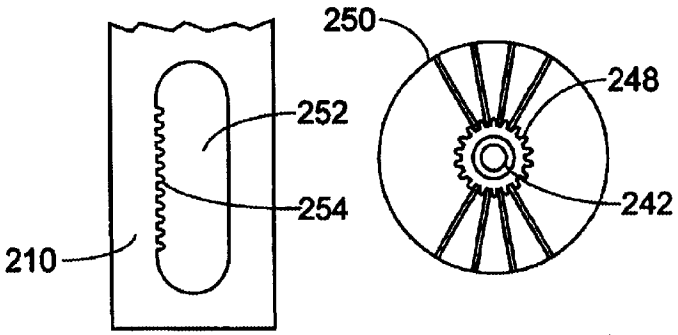

Referring now to FIGS. 10 and 11, a cassette in accordance with a third embodiment is shown. The cassette has a base 200 with a series of openings or windows 202 spaced longitudinally along the bottom wall thereof. A flexible gasket 204 having a series of through openings 206 to match those in the base 200 is adhesively secured to the inside of top surface of the base so that openings 202, 206 are disposed in registry. The gasket 204 can be made from polyurethane foam or other suitable material as may be desired.

A molded plastic louvered slide 210 is received in a slot 220 in the base. Slide 210 has window openings 222 spaced equally apart or in a manner so that when the slide is fully inserted or slid into the base, the window openings are aligned with the closed sections of the base intermediate opening 202 to close and seal the cartridge for preventing toner flow.

A toner hopper 230 is provided for installation onto base 200. This hopper may be formed by convenient means such as blow molding, vacuum forming or the like, and includes a gasket receiving groove 232 formed peripherally around the bottom edge thereof. Groove 232 closely receives a hopper seal gasket 234.

The hopper assembly is snapped onto base 200 and retained firmly in place by a series of snap hook fingers 236 integrally molded into the base, or by other suitable fastening means.

With continued reference to both FIGS. 10 and 11, a knob 250 has an axle 242, made of metal or another suitable material, which is inserted through a hole 252 in the slide and a corresponding hole 246 in base 200. Axle 242 is rotatably received in hole 246 and is prevented from removal by a lock tab, a headed pin or by other convenient means.

The knob has gear teeth 248 around the circumference or outside edge of the knob. In the preferred, embodiment, spur gear teeth are used; however, other gear teeth arrangements could be used as well. The knob is received in elongated slot or opening 252 in the slide which has an internal rack with gear teeth 254 along straight portions of the slot. Together teeth 248 and 254 form a rack and pinion assembly in which teeth 248 of the knob engage teeth 254 of the slot. This cooperating action causes the slide to slide or shift in a linear fashion relative to base 200 so that window openings 202, 206 are moved toward registry, thereby allowing toner to freely flow into the image forming apparatus. The gear teeth of the knob and the slide elongated slot permit a larger range of movement of the slide than the eccentric cam knob.

The knob can have a "tick" mark 260 which indicates open and closed positions when aligned with markings or indicia similar to indicia 152 shown in FIG. 9.

The invention has been described with reference to three preferred embodiments. Obviously, alterations and modifications will occur to others upon a reading and understanding of this specification. It is intended to include all such modifications and alterations insofar as they come within the scope of the appended claims or the equivalents thereof.

What is ciaimed:

1. A toner cartridge comprising:

a hopper having a bottom wall with at least one opening in said bottom wall;

a base which matingly engages said hopper, said base having at least one opening therein, and a slot extending from a first end to a second end;

a slide which is slidably received in said slot of said base, said slide having at least one opening therein;

a movable member comprising an eccentric cam which is inserted into a second opening in said slide, wherein rotation of said movable member results in a portion of said cam contacting said second opening of said slide, thus moving said slide with respect to said base and said hopper toward one of a first position and a second position.

2. The toner cartridge of claim 1, wherein said movable member comprises a rotatable knob.

3. A toner cartridge comprising:

a hopper having a bottom wall with at least one opening in said bottom wall;

a base which matingly engages said hopper, said base having at least one opening therein, and a slot extending from a first end to a second end;

a slide which is slidably received in said slot of said base, said slide having at least one opening therein; and, a movable member which is inserted into a second opening in said slide, wherein rotation of said movable member results in a portion of said movable member contacting said second opening of said slide for moving said slide with respect to said base and said hopper toward one of a first position and a second position, said movable member comprising a rotatable knob having a first surface and a second surface, wherein said first surface comprises a handle, and wherein said second surface comprises an eccentric cam and has an opening therein.

4. The toner cartridge of claim 3 further comprising a load tray having a slot wherein said base is received within said slot.

5. The toner cartridge of claim 3, further comprising a pin which is inserted through a second hole of said base and engages said opening of said knob.

6. The toner cartridge of claim 3, wherein said eccentric cam engages a side wall of said second opening of said slide to cause said slide to move with respect to said base.

7. The toner cartridge of claim 6, wherein said second opening of said slide is rectangular.

8. The toner cartridge of claim 3, wherein in said first position said at least one opening of said slide is substantially aligned with said at least one opening of said base and said at least one opening of said hopper to allow toner flow out of said hopper.

9. The toner cartridge of claim 3, wherein in said second position said at least one opening of said slide is substantially offset with said at least one opening of said base and said at least one opening of said hopper to prevent toner flow out of said hopper.

10. The toner cartridge of claim 3, wherein said slide comprises a plurality of openings spaced apart along a length of said slide.

11. The toner cartridge of claim 3, wherein said base and said hopper each comprises a plurality of openings spaced apart along respective lengths of said base and said hopper.

12. A toner cartridge comprising:

a hopper having a bottom wall with at least one opening in said bottom wall;

a base which matingly engages said hopper, said base having at least one opening therein, and a slot extending from a first end to a second end;

a slide which is slidably received in said slot of said base, said slide having at least one opening therein; and, a movable member communicating with a second opening in said slide, wherein rotation of said movable member results in a portion of said movable member contacting a wall of said second opening of said slide for moving said slide with respect to said base and said hopper toward one of a first position and a second position, wherein said base and said slide each further includes a label to indicate one of said first and second positions.

13. The toner cartridge of claim 12, wherein said base comprises a plurality of clips and said hopper comprises a plurality of ribs, wherein said clips engage said ribs to secure said hopper to said base.

14. The toner cartridge of claim 12, further comprising a gasket adhesively secured to said base, said gasket comprising at least one opening in registry with said at least one opening of said base.

15. A toner cartridge comprising:

a hopper having a bottom wall with at least one opening in said bottom wall;

a base which matingly engages said hopper, said base having at least one opening therein, and a slot extending from a first end to a second end;

a slide which is slidably received in said slot of said base, said slide having at least one opening therein; and, a movable member which is inserted into a second opening in said slide, wherein rotation of said movable member results in a portion of said movable member contacting said second opening of said slide, thus moving said slide with respect to said base and said hopper to one of a first position and a second position, wherein said movable member comprises an eccentric cam and an axle, said eccentric cam engaging said second opening of said slide with said axle engaging a second opening of said base.

16. A toner cartridge comprising:

a hopper having a bottom wall with at least one opening in said bottom wall;

a base which matingly engages said hopper, said base having at least one opening therein, and a slot extending from a first end to a second end;

a slide which is slidably received in said slot of said base, said slide having at least one opening therein;

rotatable knob which includes a plurality of teeth around an outside edge thereof and which is inserted into an elongated opening in said slide, said elongated opening having teeth on at least one wall thereof, wherein rotation of said knob results in said teeth of said knob contacting said teeth of said elongated opening of said slide selectively moving said slide with respect to said base and said hopper toward one of a first position and a second position.

17. A closure apparatus for a toner cartridge, comprising:

a member which is slidably received in a slot of an associated toner cartridge base, said member comprises a plurality of apertures along a length of said member;

a knob which is inserted into one of said apertures of said member in contacting relation to a side wall of said one of said apertures for causing said member to move with respect to said associated base and thereby moving said member toward one of a first position and a second position, wherein said knob comprises a first surface and a second surface, wherein said first surface comprises a handle, and wherein said second surface comprises an eccentric cam and has an opening therein.

18. The closure apparatus of claim 17, further comprising a pin which is inserted through an opening of said base and engages said opening of said knob.

19. The closure apparatus of claim 17, wherein said knob comprises an eccentric cam and an axle, wherein said eccentric cam engages a side wall of said one of said apertures of said member, thus moving said member, and said axle engages an opening of said base.

20. A closure apparatus for a toner cartridge comprising:

a member which is slidably received in a slot of an associated toner cartridge base, said member including a plurality of apertures along a length of said member, wherein one of said apertures comprises an elongated aperture having teeth on at least one side thereof;

a knob disposed in said aperture, wherein said knob includes a plurality of teeth around a circumference thereof, said knob teeth engaging said teeth of said one aperture for causing said member to move with respect to said associated base, thus moving said member toward one of a first position and a second position.

21. A toner cartridge comprising:

a toner receiving member having a bottom wall with a plurality of apertures therein;

a slide which is slidably mounted adjacent said bottom wall, said slide having a plurality of apertures therein; and, a movable member inserted into one of said slide apertures and being rotatable relative thereto for selectively moving said slide toward one of a fully opened and fully closed position, wherein said movable member comprises a knob having an eccentric cam.

* * * * *